US006189610B1

(12) United States Patent
LaClare et al.

(10) Patent No.: US 6,189,610 B1
(45) Date of Patent: Feb. 20, 2001

(54) ANCHORING TOOL

(76) Inventors: G. Maurice LaClare, P.O. Box 245; Michael H. Kobes, P.O. Box 34, both of Edam, Saskatchewan (CA), S0M 0V0

( * ) Notice: Under 35 U.S.C. 154(b), the term of this patent shall be extended for 0 days.

(21) Appl. No.: 09/250,493

(22) Filed: Feb. 16, 1999

(30) Foreign Application Priority Data

May 28, 1998 (CA) ..... 2238910

(51) Int. Cl.[7] ..... E21B 23/01
(52) U.S. Cl. ..... 166/208; 166/117.7; 166/242.1
(58) Field of Search ..... 166/382, 117.7, 166/208, 206, 242.1, 210

(56) References Cited

U.S. PATENT DOCUMENTS 4,811,785 * 3/1989 Weber ..... 166/242.1
4,947,944 * 8/1990 Coltman et al. ..... 175/73
5,275,239 1/1994 Obrejanu .
5,829,531 * 11/1998 Hebert et al. ..... 166/382

FOREIGN PATENT DOCUMENTS 1274470 9/1925 (CA) .

* cited by examiner

*Primary Examiner*—William Neuder
*Assistant Examiner*—Zakiya Walker
(74) *Attorney, Agent, or Firm*—Adrian D. Battison; Michael R. Williams

(57) ABSTRACT

An anti-rotation device prevents right-hand rotation of a tubing string within a stationary well casing. The device includes a tubular housing connected inline with the tubing string. A fixed jaw configured for gripping the well casing projects outwardly from the housing. A pair of collars free to rotate about the housing support two floating jaws, which are also configured for gripping the well casing. The floating jaws rotate about the housing between a free position in which the floating jaws are positioned adjacent the fixed jaw and the overall diameter of the device is less than the diameter of the well casing and an engaged position with the floating jaws and the fixed jaws situated on opposing sides of the housing and the overall diameter of the device is greater than the diameter of the well casing.

17 Claims, 4 Drawing Sheets

ANCHORING TOOL

FIELD OF THE INVENTION

This invention relates to anchoring tools, and more particularly to devices for anchoring a tubing string to a surrounding well casing. Specifically the anchoring tool is for anchoring the tubing string against rotational and vertical displacement in relation to the well casing.

BACKGROUND OF THE INVENTION

Oil is commonly collected from below surface reservoirs using a tubing string. Typically the tubing string is constructed in threaded sections and includes an inline pump. The pump considered is a screw-type pump including a rotary drive, a stator and a screw type rotor rotatable therein. The pumps are commonly of right-hand rotation and under certain conditions can transmit large forces to the tubing string. This tends to rotate the tubing string and release the threaded sections which is undesirable.

This problem has been addressed by J. L. Weber in Canadian Patent No. 1,274,470, which discloses a "No-Turn™ Tool" for preventing such rotation of a tubing string. The device comprises an outer tubular housing which rotates about an inner mandrel. The housing holds four retractable slips which are extended for anchoring the device to the stationary well casing. Right-hand rotation of the inner mandrel relative to the housing engages cams which extend the slips into the well casing. Rotation in the opposite direction disengages the cams and the slips are pushed away from the well casing by springs. The device is relatively complex, using both springs and cams, resulting in significant manufacturing costs.

Also addressing the problem of rotation of a tubing string, U.S. Pat. No. 5,275,239 to M. Obrejanu discloses a device for anchoring a tubing string within a stationary well casing against right-hand rotation. The device has four anchoring mechanisms spaced circumferentially about a main housing. Each anchoring mechanism includes a recess and an anchoring member free-floating within the recess. A spring urges the anchoring member outward to engage the well casing. Right-hand rotation of the device will rotate the anchoring members into a locking position. The device is also complex, requiring a spring for each anchoring member. The anchoring members are free-floating and can jam, making the device less reliable.

SUMMARY OF THE INVENTION

The present invention is a simple, robust device with only one moving part improving upon the reliability of the previous art of preventing right-hand rotation of a tubing string.

According to a first aspect of the invention there is provided an anti-rotation device to prevent right-hand rotation for a tubing string within a stationary well casing, comprising:

a tubular housing for connection to the tubing string;

a fixed jaw mounted on the tubular housing for engaging the well casing;

two floating jaws for engaging the well casing; and mounting means for mounting the two floating jaws on the tubular housing for free rotation about the housing.

According to a second aspect of the invention there is provided an anchoring device for anchoring a tubing string within a stationary well casing, the device comprising:

a tubular housing for connection to the tubing string;

a fixed jaw mounted on the tubular housing for engaging the well casing;

two floating jaws for engaging the well casing; and mounting means for mounting the two floating jaws on the tubular housing for free rotation about the housing.

It is preferred that the mounting means comprises two collars which rotate freely about the tubular housing for mounting the floating jaws.

It is also preferred that the jaws project outwardly from the tubular housing and that outer edges of the jaws are configured for gripping the well casing.

The two collars may include a first collar rotating above the fixed jaw and a second collar rotating below the fixed jaw. The collars may also include stops which engage the fixed jaw to inhibit full rotation of the floating jaws.

There may be provided teeth on the jaws oriented to prevent rotational and vertical displacement of the device.

According to a further aspect of the invention there is provided an anti-rotation device to prevent right-hand rotation for a tubing string within a stationary well casing having a prescribed diameter with production tubing along the casing and the anti-rotation device connected to the tubing string, the device comprising:

a tubular housing for connection to the tubing string;

a fixed jaw projecting outwardly from the tubular housing and configured for gripping the well casing;

two floating jaws projecting outwardly from the housing and configured for gripping the well casing; and mounting means for mounting the two floating jaws for free rotation about the tubular housing between a free position in which the floating jaws are positioned adjacent the fixed jaw and the overall diameter of the device is less than the diameter of the well casing and an engaged position with the floating jaws and the fixed jaw situated on opposing sides of the housing and the overall diameter of the device is greater than the diameter of the well casing.

BRIEF DESCRIPTION OF THE DRAWINGS

In drawings which illustrate an embodiment of the invention.

DETAILED DESCRIPTION

Figure 4:
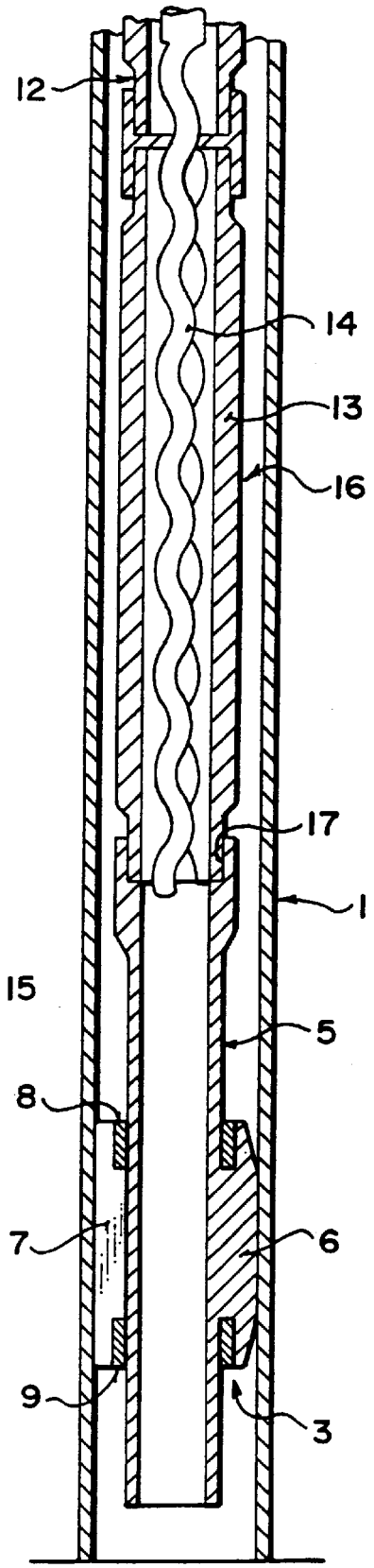
FIG. 4 is a diagrammatic cross-section in a vertical plane of an anchoring device located within a well casing.

Reference will now be made to FIG. 4 which shows the device 3 as it will be used for a production tubing string 12 with an inline progressive cavity pump 16. The pump 16 considered is a screw-type pump including a stator 13 and a screw-type rotor 14 therein. The device 3 is connected to the tubing string 12 by a threaded end 17 of device 3. If the right-hand rotation of rotor 14 within the pump 16, transmits sufficient torque to the stator 13, the stator 13 begins to rotate. This rotation is transmitted to the device 3 and the device 3 will engage the well casing 1 as the following will describe.

Figure 1:
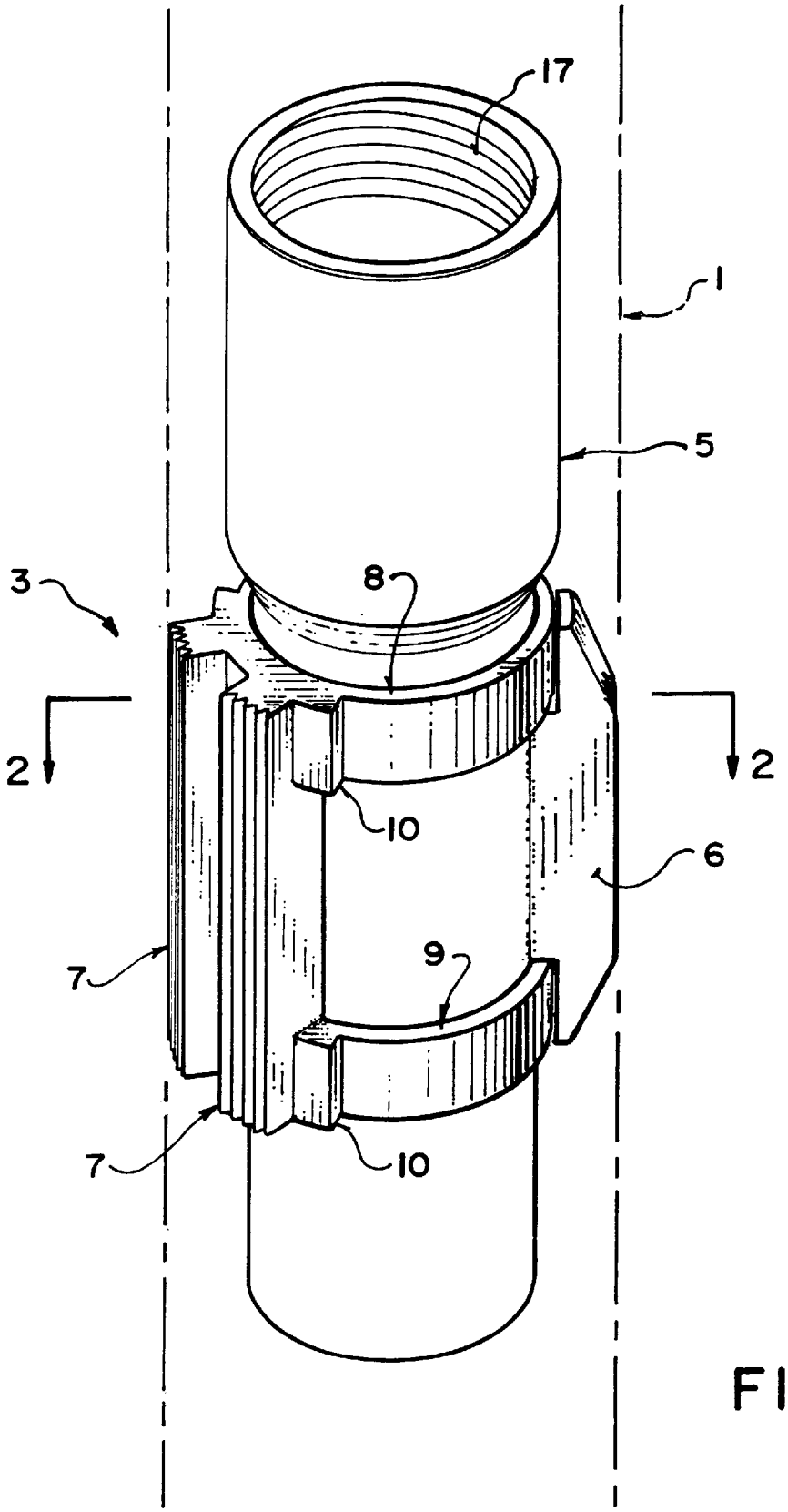
FIG. 1 is an isometric view of the device of the present invention engaged within a well casing.

Reference will now be made to FIG. 1, which shows an isometric view of the device of the present invention 3 engaged in the well casing 1. The device 3 is in the form of a tubular housing 5. A fixed jaw 6 projects outwardly from the housing 5 and is configured for gripping the well casing 1. Also, two floating jaws 7 project outwardly from the housing 5 and are configured for gripping the well casing 1. The two floating jaws 7 are mounted on a first collar 8 and a second collar 9 which rotate about the tubular housing 5. The first collar 8 rotates about the housing 5 above the fixed jaw 6, while the second collar 9 rotates about the housing 5 below the fixed jaw 6. The first collar 8 and second collar 9 include stops 10 which engage the fixed jaw 6. The stops 10 inhibit the full rotation of the collars 8 and 9 about the housing 5 and prevent the floating jaws 7 from contacting the fixed jaw 6.

Figure 2:
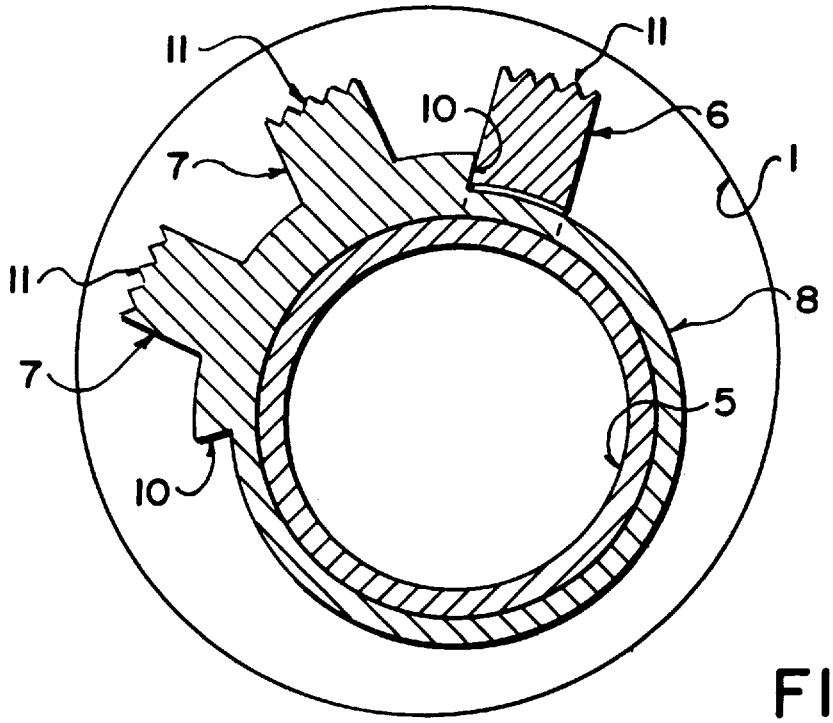
FIG. 2 is a cross-sectional view taken along the line 2—2 of FIG. 1, showing the functional components of the device of the present invention in a position where it is free to rotate within a well casing.

Reference will now be made to FIG. 2 which shows a cross-section of device 3 in a free position. The floating jaws 7 and the fixed jaw 6 are situated on the same side of the housing 5 such that the overall diameter of the device 3 is less that the diameter of the well casing 1. If the housing 5 is rotated to the left, as viewed from above, the fixed jaw 6 will rotate with the housing 5 and contact the stops 10 situated on the collars 8,9. The device 3 is free to further rotate as the fixed jaw 6 engages the stops 10 on the collars 8,9 and rotates the floating jaws 7 with the housing 5. If the housing 5 is rotated to the right, as viewed from above, the floating jaws 7 will engage the well casing 1 and the fixed jaw 6 will rotate away from the floating jaws 7. Further right-hand rotation is prevented when the device reaches the position of FIG. 3 and the jaws 6,7 engage the well casing 1. The jaws 6,7 include teeth 11 which are oriented to extend vertically for engaging the well casing and preventing rotation.

Figure 3:
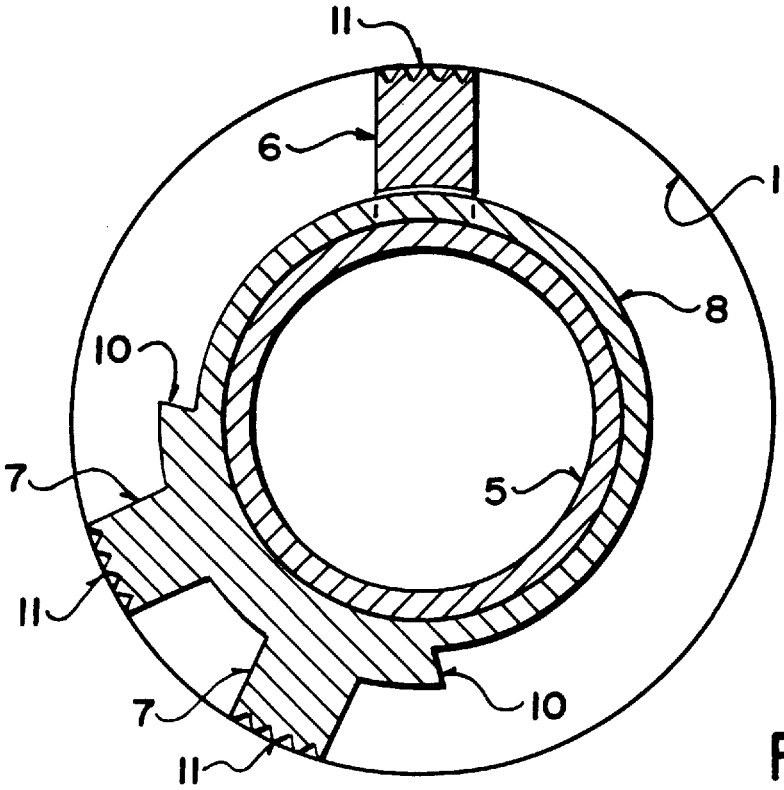
FIG. 3 is a cross-sectional view taken along the same line as FIG. 2, showing the functional components of the device of the present invention in a locked position where it is not free to rotate within a well casing.

Reference will now be made to FIG. 3 which shows a cross-section of device 3 in an engaged position. The floating jaws 7 and the fixed jaw 6 are situated on opposite sides of the housing 5 such that the overall diameter of the device 3 is greater that the diameter of the well casing 1. If the device 3 is rotated to the right, as viewed from above, the fixed jaw 6 and floating jaws 7 will engage further into the well casing 1 and prevent further rotation. If the device 3 is rotated to the left, as viewed from above, the induced rotation of the housing 5 will disengage the fixed jaw 6 from the well casing 1 and the housing 5 will continue to rotate freely until the fixed jaw 6 contacts the stops 10 of the collars 8 and 9, at which point the device 3 reaches the position as described of FIG. 2.

Figure 5:
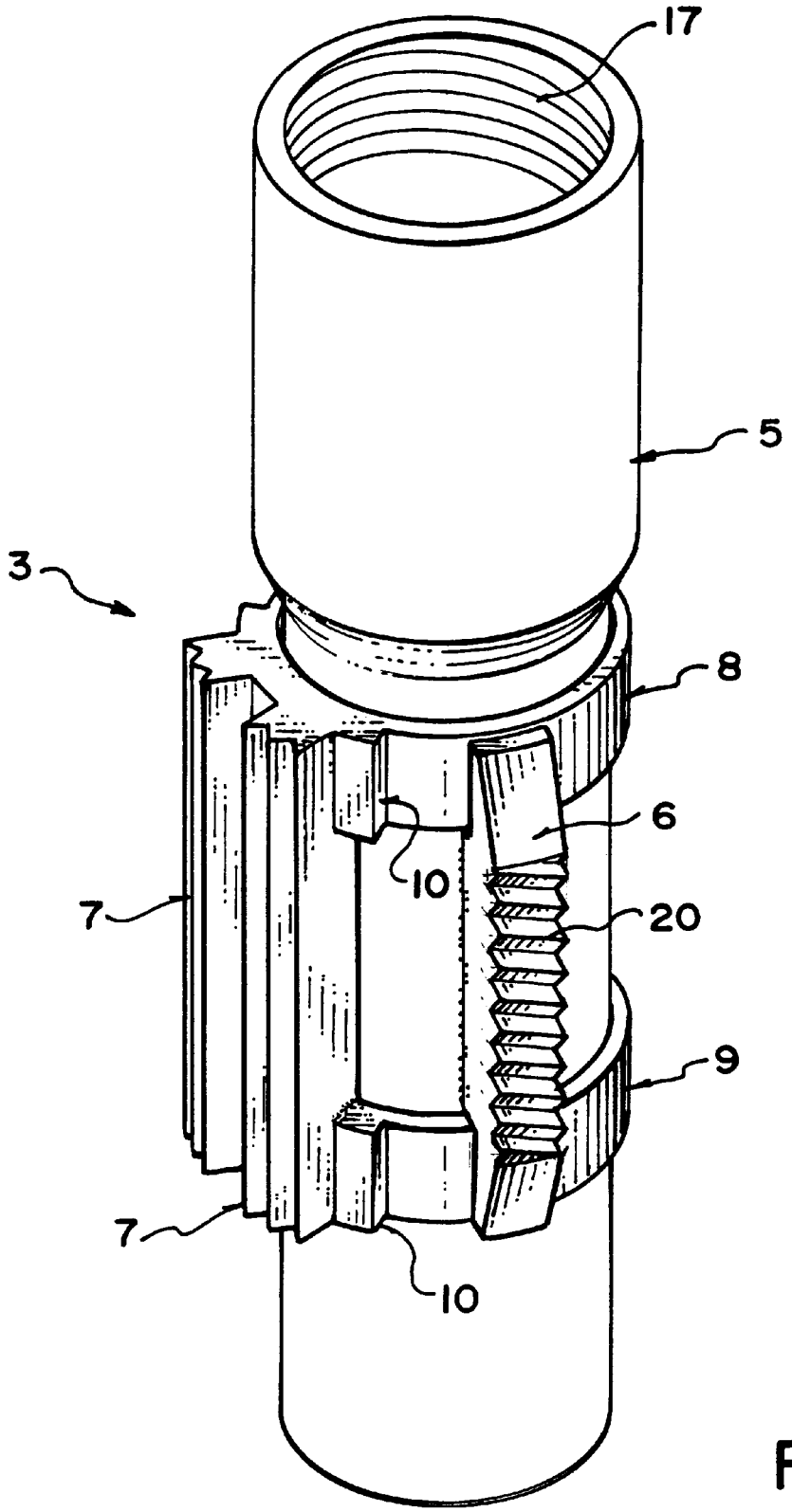
FIG. 5 is an isometric view of a further embodiment of the present invention.

A second embodiment of the device is shown in FIG. 5 for use as an anchoring device in addition to preventing rotation of the tubing string. The floating jaws 7 are arranged similarly to the first embodiment. The fixed jaw 6 however includes teeth 20 which are oriented to extend generally horizontally. The teeth 20 are arranged to engage the well casing and limit vertical displacement of the device.

For use as an anchor, the device is threadably connected to the tubing string within the well casing. The device is inserted into the well casing in the free position of FIG. 2 and then rotated into the engaged position of FIG. 3. The tubing string is then pulled upwardly to engage the teeth into the well casing in a vertical direction. A dognut fastened to the tubing string maintains tension on the tubing string such that the teeth remain engaged in the vertical direction. Rotation of the tubing string will apply a torque to the string when the dognut is seated and anchor the device from any further rotational displacement.

In further embodiments, the teeth may extend at any combination of angles between vertical and horizontal directions to anchor the device and the tubing string from both rotational and vertical displacement.

While two embodiments of the present invention have been described in the foregoing, it is to be understood that other embodiments are possible within the scope of the invention. The invention is to be considered limited solely by the scope of the appended claims.

What is claimed is:

1. An anchoring device for anchoring a tubing string within a stationary well casing, the device comprising:

a tubular housing for connection to the tubing string;

a fixed jaw mounted on the tubular housing in fixed relation to the tubular housing for rotation with the tubular housing for engaging the well casing;

two floating jaws for engaging the well casing; and floating jaw mounts mounting the two floating jaws on the tubular housing for free rotation about the housing relative to the fixed jaw for varying an overall diameter of the device as the floating jaws are displaced relative to the fixed jaw.

2. The device of claim 1 wherein the floating jaw mounts comprise two collars which rotate freely about the tubular housing mounting the floating jaws for rotation relative to the housing.

3. The device of claim 2 wherein the two collars comprise a first collar rotating above the fixed jaw and a second collar rotating below the fixed jaw for mounting the two floating jaws on the tubular housing.

4. The device of claim 3 wherein the first and second collars include stops which engage the fixed jaw to inhibit full rotation of the floating jaws.

5. The device of claim 1 wherein the floating jaws and the fixed jaw project outwardly from the tubular housing.

6. The device of claim 1 wherein outer edges of the floating jaws and the fixed jaw are configured for gripping the well casing.

7. The device of claim 1 wherein there is provided teeth on the floating jaws and the fixed jaw oriented to prevent rotational displacement of the device.

8. The device of claim 1 wherein there is provided teeth on the floating jaws and the fixed jaw oriented to prevent vertical displacement of the device.

9. An anti-rotation device to prevent right-hand rotation for a tubing string within a stationary well casing, the device comprising:

a tubular housing for connection to the tubing string;

a fixed jaw mounted on the tubular housing in fixed relation to the tubular housing for rotation with the tubular housing for engaging the well casing;

two floating jaws for engaging the well casing; and floating jaw mounts mounting the two floating jaws on the tubular housing for free rotation about the housing relative to the fixed jaw for varying an overall diameter of the device as the floating jaws are displaced relative to the fixed jaw.

10. The device of claim 9 wherein the floating jaw mounts comprise two collars which rotate freely about the tubular housing mounting the floating jaws for rotation relative to the housing.

11. The device of claim 10 wherein the two collars comprise a first collar rotating above the fixed jaw and a second collar rotating below the fixed jaw for mounting the two floating jaws on the tubular housing.

12. The device of claim 11 wherein the first and second collars include stops which engage the fixed jaw to inhibit full rotation of the floating jaws.

13. The device of claim 9 wherein the floating jaws and the fixed jaw project outwardly from the tubular housing.

14. The device of claim 9 wherein outer edges of the floating jaws and the fixed jaw are configured for gripping the well casing.

15. The device of claim 9 wherein there is provided teeth on the floating jaws and the fixed jaw oriented to prevent rotational displacement of the device.

16. The device of claim 9 wherein there is provided teeth on the floating jaws and the fixed jaw oriented to prevent vertical displacement of the device.

17. An anti-rotation device to prevent right-hand rotation for a tubing string within a stationary well casing having a prescribed diameter, the anti-rotation device being connected to the tubing string, the device comprising:

a tubular housing for connection to the tubing string;

a fixed jaw projecting outwardly from the tubular housing in fixed relation to the tubular housing for rotation with the tubular housing and configured for gripping the well casing;

two floating jaws projecting outwardly from the housing and configured for gripping the well casing; and mounting means for mounting the two floating jaws for free rotation about the tubular housing relative to the fixed jaw between a free position in which the floating jaws are positioned adjacent the fixed jaw and the overall diameter of the device is less than the diameter of the well casing and an engaged position with the floating jaws and the fixed jaw situated on opposing sides of the housing and the overall diameter of the device is substantially equal to the diameter of the well casing.

* * * * *